US011156436B2

(12) United States Patent
Beck

(10) Patent No.: US 11,156,436 B2
(45) Date of Patent: Oct. 26, 2021

(54) DYNAMIC LOAD CARRIAGE SYSTEM

(75) Inventor: Jason Beck, Peoria, AZ (US)

(73) Assignee: TYR Tactical, LLC, Peoria, AZ (US)

( * ) Notice: Subject to any disclaimer, the term of this patent is extended or adjusted under 35 U.S.C. 154(b) by 69 days.

(21) Appl. No.: 13/431,860

(22) Filed: Mar. 27, 2012

(65) Prior Publication Data

US 2013/0256358 A1 Oct. 3, 2013

(51) Int. Cl.

| | |
|---|---|
| ***A45F 3/04*** | (2006.01) |
| ***F41H 1/02*** | (2006.01) |
| ***A45F 3/08*** | (2006.01) |
| *A45F 3/14* | (2006.01) |

(52) U.S. Cl.

CPC ..... *F41H 1/02* (2013.01); *A45F 3/08* (2013.01); *A45F 2003/146* (2013.01); *Y10T 29/4984* (2015.01); *Y10T 29/49826* (2015.01)

(58) Field of Classification Search

CPC ..... A45F 3/06; A45F 3/10; A45F 3/08; A45F 2003/146; Y10T 24/3412; Y10T 29/49826; Y10T 29/4984; F41H 1/02

USPC ..... 224/641, 101, 633, 634, 637, 628, 261, 224/262, 635, 263, 630, 636; 29/428, 29/434; 24/315

See application file for complete search history.

(56) References Cited

U.S. PATENT DOCUMENTS

| | | | | |
|---|---|---|---|---|
| 860,395 | A | 7/1907 | Lindsey | |
| 860,935 | A | 7/1907 | Lindsey | |
| 2,008,201 | A * | 7/1935 | Chute | A45F 3/08 224/262 |
| 2,436,581 | A * | 2/1948 | Lazare | A41F 11/02 2/305 |
| 3,739,961 | A * | 6/1973 | Soukeras | A45C 1/04 224/579 |
| 3,957,184 | A * | 5/1976 | Shurman | A45F 3/04 224/630 |
| 4,303,186 | A * | 12/1981 | Ollinger, IV | A45F 3/08 224/634 |
| 4,369,903 | A | 1/1983 | Wilkes | |
| 5,915,606 | A | 6/1999 | Jensen | |
| 6,276,584 | B1 | 8/2001 | McLachlan | |

(Continued)

FOREIGN PATENT DOCUMENTS

| | | |
|---|---|---|
| DE | 102009033518 B | 8/2010 |
| EP | 0650677 | 5/1995 |

(Continued)

OTHER PUBLICATIONS

MM's Crye Precision p. 4, Printed Dec. 11, 2013, "Crye Precision CAGE Plate Carrier (CPC)", http://www.militarymorons.com/gear/crye4.html.

(Continued)

*Primary Examiner* — Matthew T Theis
(74) *Attorney, Agent, or Firm* — KW Law, LLP

(57) ABSTRACT

A dynamic load carriage system having a movable cross support member having a first elongated support member in transverse orientation relative to a second elongated support member with one end of the first and second elongated support members being coupled to a load carrier being worn or carried by an individual and another end coupled to a base belt for supporting the load carrier substantially along the hips of an individual wearing the load carrier whenever the individual changes body position is disclosed.

20 Claims, 11 Drawing Sheets

(56) References Cited

U.S. PATENT DOCUMENTS

| | | | | |
|---|---|---|---|---|
| 6,431,424 | B1 * | 8/2002 | Smith | A01K 97/10 224/153 |
| 2005/0005343 | A1 | 1/2005 | Johnson | |
| 2011/0011903 | A1 * | 1/2011 | Buffinton et al. | 224/191 |

FOREIGN PATENT DOCUMENTS

| | | | | |
|---|---|---|---|---|
| EP | 2645046 | A3 | 12/2014 | |
| FR | 2652727 | A1 * | 4/1991 | 224/641 |
| WO | WO 0041589 | A2 | 7/2000 | |
| WO | WO 2004082426 | A2 | 9/2004 | |
| WO | WO2006080854 | | 8/2006 | |
| WO | WO 2006080854 | A1 * | 8/2006 | A45F 3/08 |

OTHER PUBLICATIONS

Crye Precisioni, Printed Dec. 11, 2013, "StKSS Load System", http://www.cryeprecision.com/P-BLC02802LG0/Stkss%e2%84%a2-Load-System.

Australian Patent Examination Report dated Dec. 3, 2013 in Australian patent application No. 2012202474.

TYR Tactical XFrame Dynamic Load Carriage—Soldier Systems: Published Feb. 12, 2013. Retrieved from the internet Nov. 13, 2013; http://soldiersystems.net/2013/02/12/tyr-tactical-2/.

Office Action issued by the Canadian Patent Office dated Feb. 4, 2014 in Canadian Patent Application No. 2,775,927.

European Search Report dated Nov. 26, 2014 in corresponding European patent application No. 12166379.3.

Canadian Search Report dated Sep. 25, 2014 in corresponding Canadian patent application No. 2775927.

Response to Office Action, Canadian Patent Application No. 2,775,927, filed Aug. 5, 2014, 23 pages.

Response to Search Report, Canadian Patent Application No. 2,775,927, filed Mar. 25, 2015, 14 pages.

Response to Examination Report No. 1, Australian Patent Application No. 2012202474, filed Mar. 28, 2014, 24 pages.

Response to Search Report, European Patent Application No. 12166379.3, filed Jun. 24, 2015, 15 pages.

Examination Report No. 2, Australian Patent Application No. 2012202474, dated Apr. 2, 2014, 24 pages.

Response to Examination Report No. 2, Australian Patent Application No. 2012202474, filed Nov. 27, 2014, 15 pages.

Examination Report No. 3, Australian Patent Application No. 2012202474, dated Dec. 23, 2014, 3 pages.

Examination Report No. 4, Australian Patent Application No. 2012202474, dated Dec. 24, 2014, 3 pages.

Response to Examination Report Nos. 3 and 4, Australian Patent Application No. 2012202474, filed Jul. 17, 2015, 27 pages.

Notice of Allowance, Canadian Patent Application No. 2,775,927, dated Sep. 17, 2015, 1 pages.

* cited by examiner

DYNAMIC LOAD CARRIAGE SYSTEM

FIELD

This document relates generally to a dynamic load carriage system and in particular to a dynamic load carriage system that compensates for the weight shift of a load whenever an individual assumes different body positions.

BACKGROUND

An individual carrying a load, such as wearing a bulletproof vest with ceramic plates or a backpack storing a heavy load, may have difficulty in maintaining their balance when the individual assumes different body positions. For example, FIG. 1A shows a conventional protective vest 2 in which the weight 500 produced by the load carried by the protective vest 2 is distributed and applied to the individual's shoulders through the shoulder pads 4 and 6 of the protective vest 2 when the individual stands substantially upright. However, when the individual changes body position, the shift in load can cause the individual to lose their balance as the weight of the load is redistributed outside the core of the individual's body due to the change in body position.

In response to this issue of weight distribution, a conventional load carriage system 7 was developed that is attached to a protective vest 8 for carrying the weight applied by a load of a protective vest 8. As shown in FIGS. 1B and 2, the conventional load carriage system 7 includes a pair of right and left support arms 16 and 18 each having one end fixedly engaged to protective vest 8 and an opposing end fixedly engaged to a belt 14 such that the support arms 16 and 18. The protective vest 8 further includes a pair of right and left shoulder pads 10 and 12 configured to contact an individual's shoulders and carry a portion of the weight of the protective vest 8. The arrangement of the right and left support arms 16 and 18 fixedly engaged between the protective vest 8 and the belt 14 allows for substantially most of the weight 502 of the protective vest 8 to be applied to the belt 14 through the right and left support arms 16 and 18 rather than solely by the shoulder pads 10 and 12. However, an individual wearing the protective vest 8 with the conventional load carriage system 7 may not be able to maintain proper stability or balance when assuming different body positions since the left and right support arms 16 and 18 are fixedly attached between the protective vest 8 and the belt 14 and therefore not capable of adapting to shifts in the load when the individual assumes different body positions. Although the conventional load carriage system 7 functions well for its intended purpose, further improvements in the art are desired, especially for individual's wearing a protective vest 8 for assuming different tactical body positions, such as shooting, self defense or evasion.

SUMMARY

In an embodiment, a dynamic load carriage system may include a base belt and a support cross member movably coupled to the base belt, wherein the support cross member includes a first elongated support member coupled to the base belt and a second elongated support member coupled to the base belt, and wherein the first elongated support member is in transverse orientation to the second elongated support member.

In one embodiment, a dynamic load carriage system may include a load carrier and a support cross member movably coupled to the load carrier, wherein the support cross member includes a first elongated support member coupled to the load carrier and a second elongated support member coupled to the load carrier, and wherein the first elongated support member is in transverse orientation relative to the second elongated support member. A base belt is coupled to the first elongated support member and the second elongated support member for supporting the load carrier.

In another embodiment a dynamic load carriage system may include a load carrier and a support cross member movably coupled to the load carrier, wherein the support cross member includes a first elongated support member coupled to the load carrier and a second elongated support member coupled to the load carrier, wherein at least one of the first elongated support member and the second elongated support member moves in response to the load carrier assuming a different orientation. A base belt is coupled to the first elongated support member and the second elongated support member for supporting the load carrier.

In yet another embodiment, a method for manufacturing a dynamic load carriage system may include:

- coupling a first end of a first elongated support member to a load carrier and coupling a first end of a second elongated support member to the load carrier; and
- coupling a second end of the first elongated support member to a base belt and coupling a second end of the second elongated support member to the base belt such that the first elongated support member is in transverse orientation relative to the second elongated support member.

Additional objectives, advantages and novel features will be set forth in the description which follows or will become apparent to those skilled in the art upon examination of the drawings and detailed description which follows.

BRIEF DESCRIPTION OF THE DRAWINGS

Corresponding reference characters indicate corresponding elements among the view of the drawings. The headings used in the figures should not be interpreted to limit the scope of the claims.

DETAILED DESCRIPTION

Figure 1B:
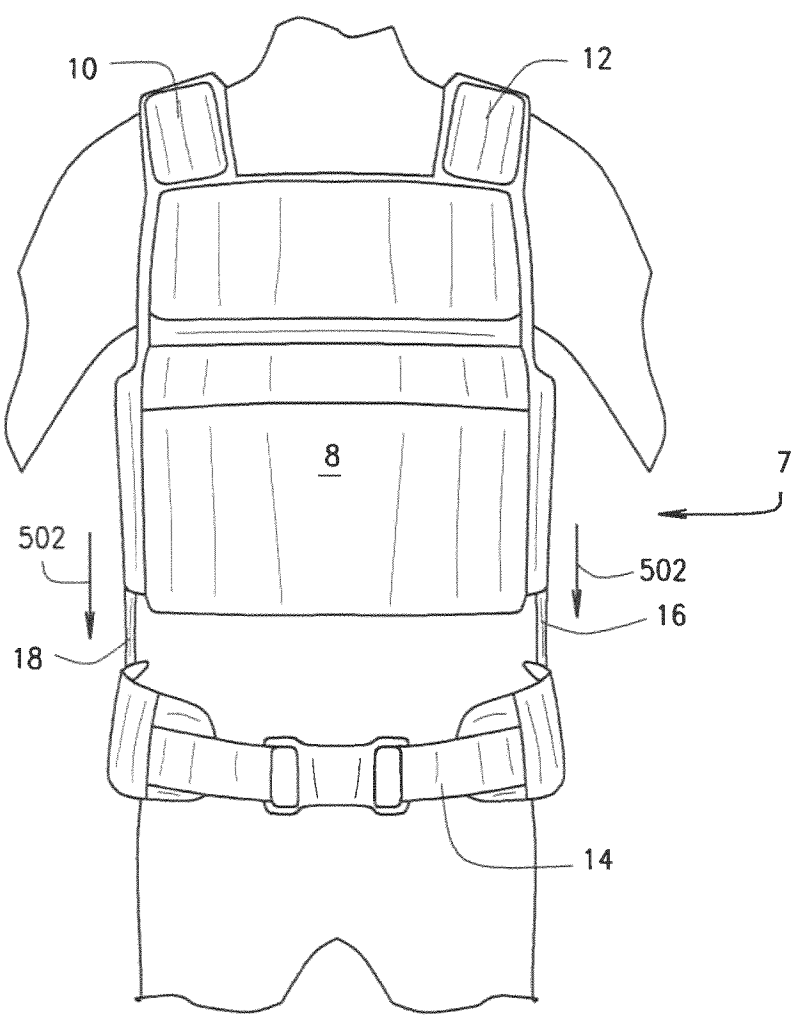
FIG. 1B PRIOR ART
FIGS. 1A and 1B are simplified illustrations of two different types of prior art protective vests showing the manner in which the load of each protective vest is carried by an individual.
Figure 1A:
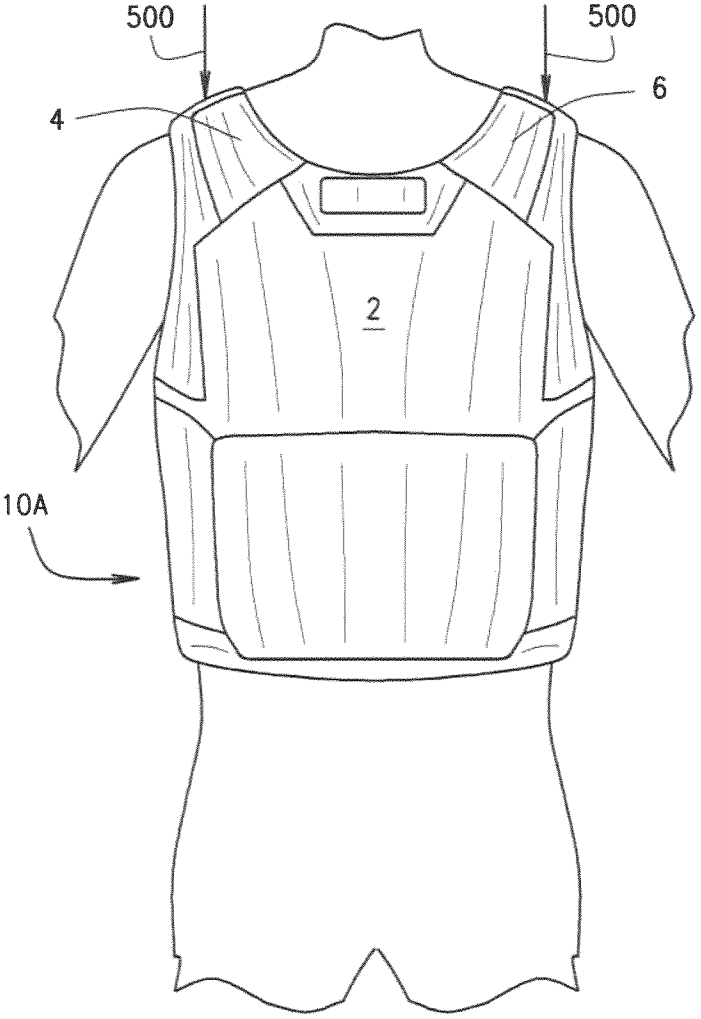
FIG. 1A PRIOR ART
Figure 2:
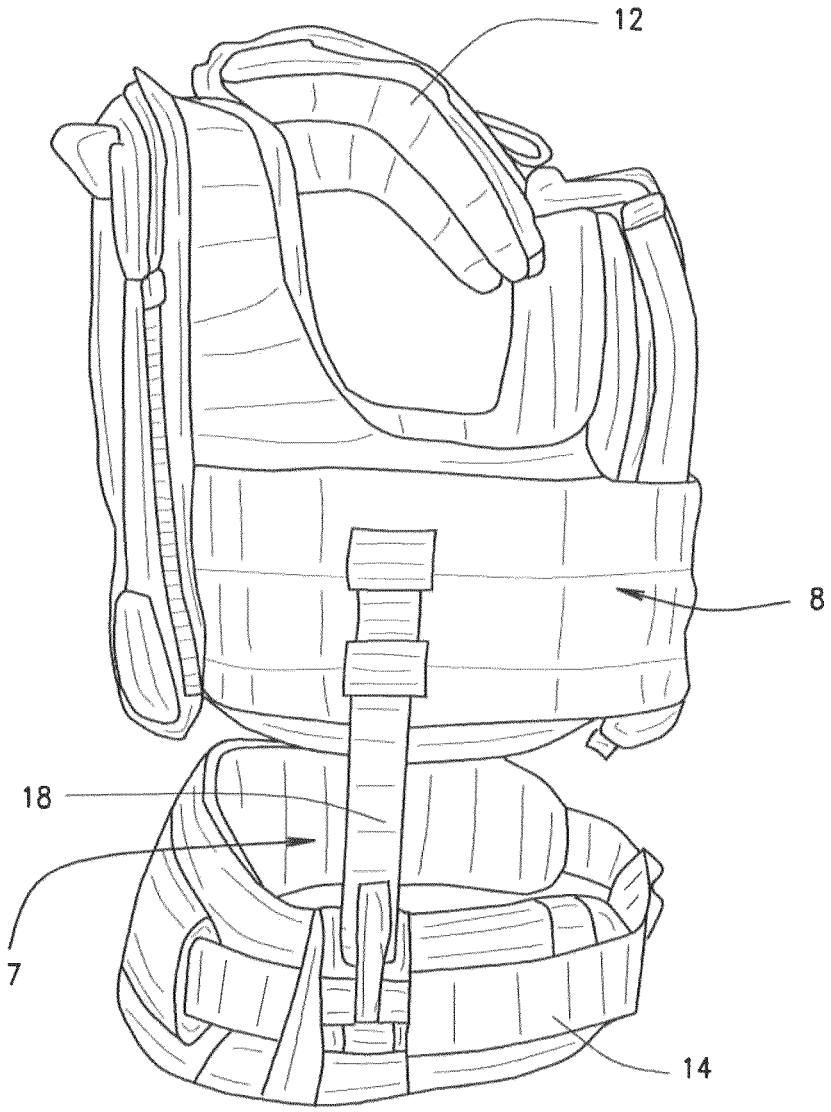
FIG. 2 PRIOR ART
FIG. 2 is a side view of the protective vest of FIG. 1B.

As described herein, a dynamic load carriage system includes a base belt coupled to a movable cross support member that is movably engaged to a load carrier through a cross channel member attached to a load carrier. The movable cross support member includes a first elongated support member in transverse orientation with a second elongated support member for supporting and compensating for the shifting weight of the load carrier when the individual assumes different body positions. In one aspect, the first elongated support member and/or the second elongated support member may move in a sliding action, bending action, rotating action and/or twisting action to compensate for the shifting load of the load carrier as the individual assumes different body positions. As a result of the compensating action of the movable support member, the dynamic load carriage system directs the weight of the load carrier substantially along the base belt and hips of the individual regardless of the body position undertaken by the individual.

Referring to the drawings, one embodiment of a dynamic load carriage system is illustrated and generally indicated as 100 in FIGS. 3-18. In general, the dynamic load carriage system 100 is configured to be engaged to a load carrier, such as a protective vest 106 (FIG. 6) or a backpack 108 (FIG. 7) for supporting a load carried by either the protective vest 106 or a backpack 108 when an individual assumes differently body positions. However, it is contemplated that the dynamic load carriage system 100 may be used with any type of load carrier that is either carried or worn by an individual, such as military gear, tactical gear, mountain climbing gear, and sporting gear.

Figure 3:
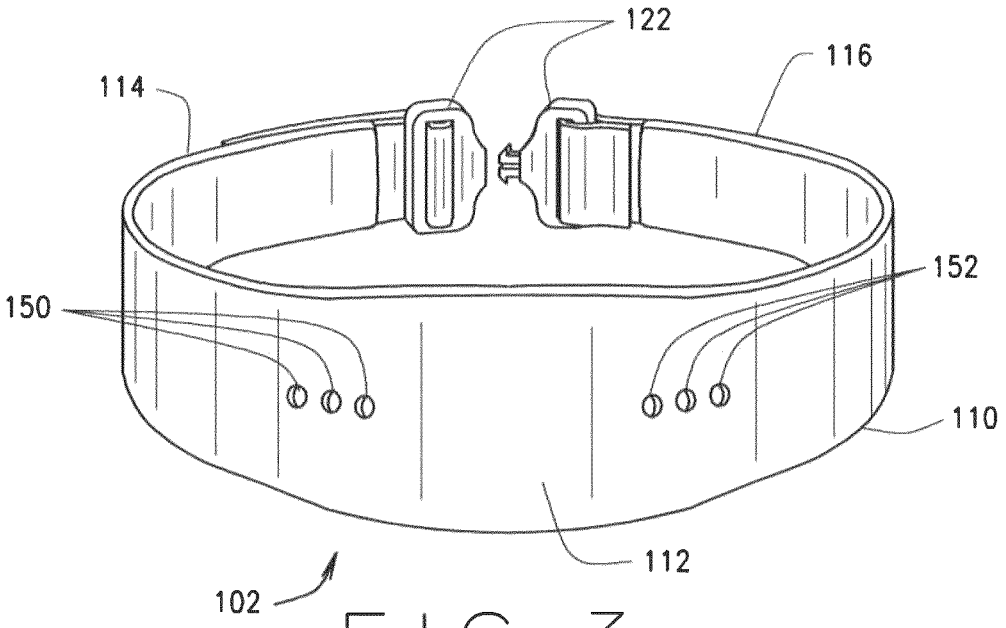
FIG. 3 is a perspective view of a base belt for a dynamic load carriage system.
Figure 4:
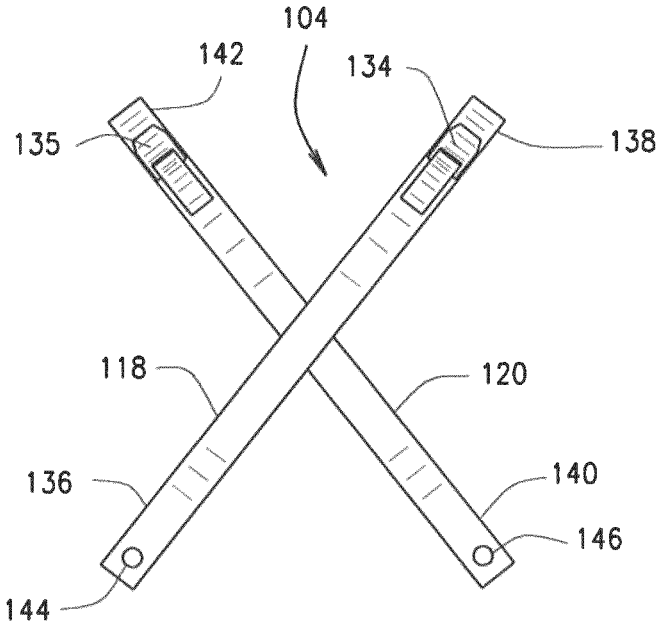
FIG. 4 is a perspective view of a support cross member for the dynamic carriage system.

Referring to FIGS. 3 and 4, the dynamic load carriage system 100 includes a base belt 102 engaged to a movable support cross member 104 that is configured to engage and support the weight of the protective vest 106 or backpack 108. The base belt 102 is configured to be worn around or proximate the individual's hips such that the weight of the load supported by the dynamic load carriage system 100 is applied along the individual's hips regardless of the body position assumed by the individual. The support cross member 104 is made from a bendable material, such a sturdy fabric material, a synthetic material, a plastic material, a metallic material, and a combination thereof that may undergo a bending action, a sliding action, a twisting action and/or a rotating action when a load carried by the individual is shifted so that the shifted weight applied by the load is distributed from the movable support cross member 104 to the base belt 102 and then along the hips of the individual in a manner that permits the individual to maintain a stable body position.

Referring to FIG. 4, the movable support cross member 104 of the dynamic load carriage system 100 may include a first elongated support member 118 and a second elongated support member 120 which are configured and arranged to move relative to each other, such as in a sliding action when the load carrier changes orientation when the individual wearing the load carrier changes body position. In addition, the first and second elongated support members 118 and 120 are each oriented such that the first and second elongated support members 118 and 120 are in transverse orientation relative to each other when attached to the protective vest 106 or backpack 108. In some embodiments, the first elongated support member 118 includes a first end portion 136 that defines an aperture 144 and an opposite second end portion 138 having a securing strap 134 configured to engage a buckle 132 for securing the second end portion 138 to either the protective vest 106 or backpack 108. Similarly, the second elongated support member 120 includes a first end portion 140 defining an aperture 146 and an opposite second end portion 142 having a securing strap 135 configured to engage a buckle 133 for securing the second end portion 142 to either the protective vest 106 or backpack 108.

As shown in FIG. 3, the base belt 102 includes an elongated belt body 110 defining a rear strap portion 112 that communicates with a left front strap portion 114 and right front strap portion 116. In some embodiments, the left and right front strap portions 114 and 116 may collectively include a buckle arrangement 122 configured to connect the left front strap portion 114 to the right front strap portion 116 for securing the base belt 102 to the individual. However, in some embodiments, other means for connecting the front strap portions 114 and 116 together may include, but are not limited to, a VELCRO™ arrangement or a strap and buckle arrangement.

Figure 5A:
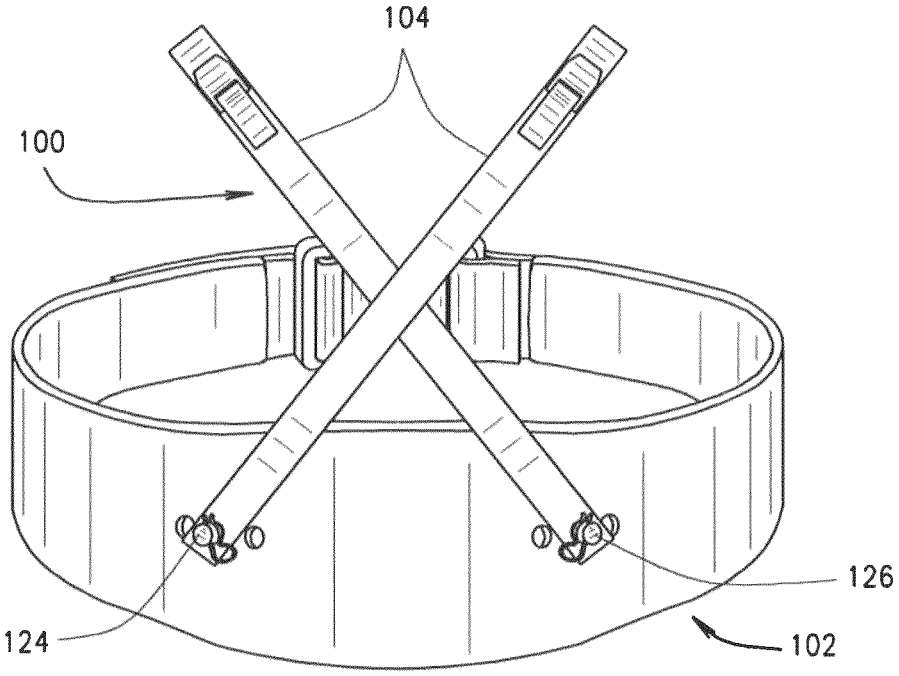
FIGS. 5A and 5B are perspective views of the dynamic load carriage system showing two different arrangements for engaging a support cross member to the base belt.

Referring to FIGS. 3 and 5A, in some embodiments, the rear strap portion 112 of the base belt 102 may include a first set of securing holes 150 spaced apart from a second set of securing holes 152. In some embodiments the first and second sets of securing holes 150 and 152 are configured to have a respective rod 124 and 126 inserted through one of the respective set of securing holes 150 and 152 for engaging one of the first end portions 136 and 140 for the first and second elongated support members 118 and 120, respectively, to the base belt 102. When each of the rods 124 and 146 is engaged through a respective one of the first and second securing apertures 144 and 146 for the first and second elongated support members 118 and 120, respectively, cotter pins 160 and 162 are then inserted through each respective rod 124 and 136. The arrangement of the cotter pins 160 and 162 engaged to a respective rod 150 and 152 permits the respective first end portions 136 and 140 for the first and second elongated support members 118 and 120 to be in rotatable engagement with the base belt 102 such that the respective end portions 136 and 140 are capable of rotating when an individual assumes different body positions and shifts the load being carried by the protective vest 106 and backpack 108.

Figure 5B:
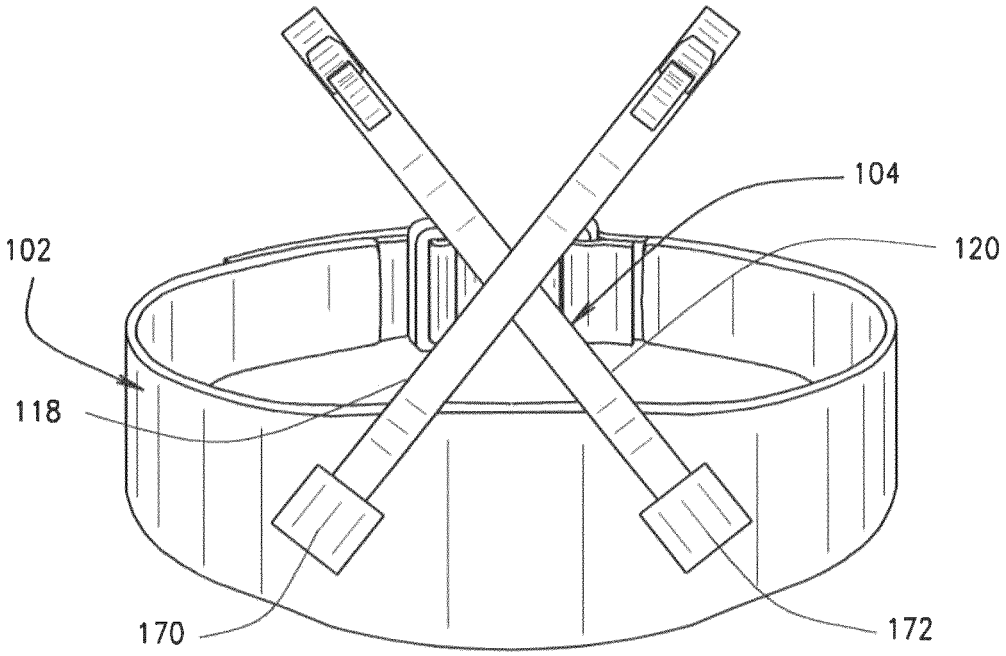

Referring to FIG. 5B, in other embodiments a first sleeve 170 and a second sleeve 172 may be secured or formed onto the base belt 102 such that respective pockets (not shown) are formed by each of the first and second sleeves 170 and 172. The first and second sleeves 170 and 172 are configured to receive the respective end portions 136 and 140 of first and second elongated support members 118 and 120. In this embodiment, the sleeves 170 and 172 permit the first and second elongated support members 118 and 120 to slide when attached to the protective vest 106 or backpack 108, rather than rotate when a cotter pin arrangement is engaged with the first and second support members 118 and 120.

Figure 6:
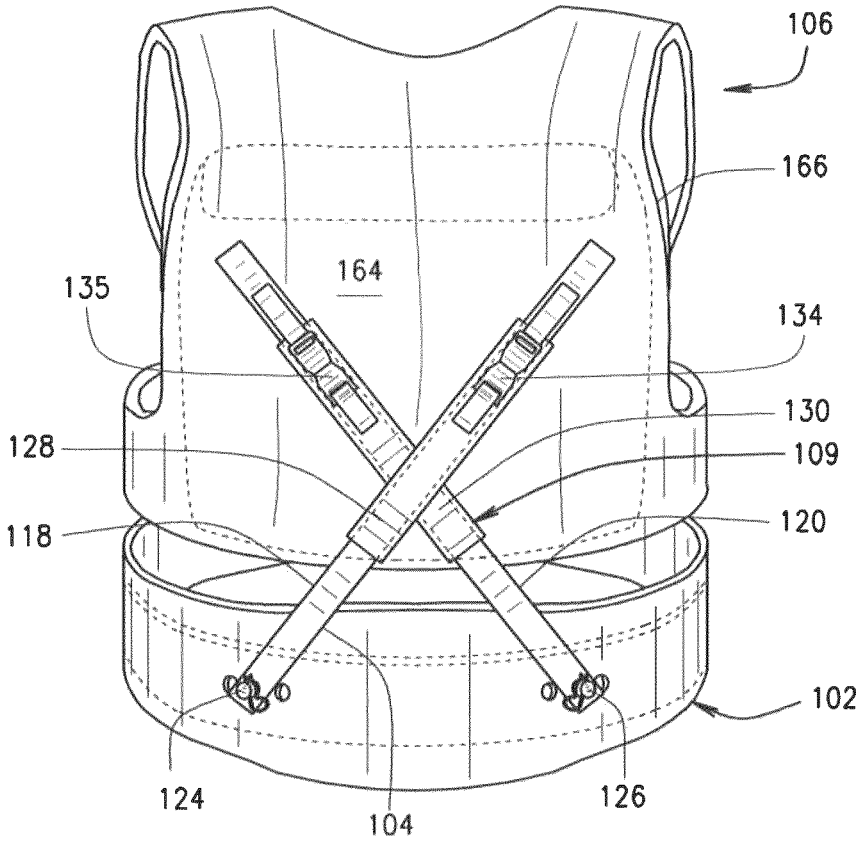
FIG. 6 is a front view of the dynamic load carriage system used with a protective vest.

Referring to FIG. 6, as noted above the dynamic load carriage system 100 may be used with a protective vest 106, such as a ballistic vest, a bulletproof vest, a bullet-resistant vest, which may be made from layers of woven or laminated fibers for protection against firearm fired projectiles as well as soft vests having metal or ceramic plates for protection against heavier caliber rifle rounds. In one embodiment, the movable support cross member 104 may be engaged to the protective vest 106 using a cross channel member 109 that is sewn or otherwise attached to a rear carriage 164 of the protective vest 106. In some embodiments, the cross channel member 109 defines a first channel 128 in transverse orientation relative to a second channel 130 which are configured to receive the first and second elongated support members 118 and 120, respectively. In addition, the first and second channels 128 and 130 are configured to permit the first and second elongated support members 118 and 120 to slide, twist, rotate, or bend within the respective first and second channels 128 and 130. As noted above, the first elongated support member 118 may include a strap 135 at one end configured to engage a buckle 132 on the cross channel member 109 for securing the first elongated support member 118 to the cross channel member 109. Similarly, the second elongated support member 120 may also include a strap 135 configured to engage a buckle 133 on the cross channel member 109 for securing the second elongated support member 120 to the cross channel member 109.

The arrangement of the movable support cross member 104 engaged to the base belt 102 and the cross channel member 109 allows the base belt 102 to support the weight of the protective vest 106, such as combined weight of a rear carriage 164 and a front carriage 166 that form the protective vest 106, along the hips of the individual wearing the protective vest 106, especially when the individual assumes different body positions, such as bending, kneeling, crouching, etc. In addition, the ability of the first and second elongated support members 118 and 120 to slide, twist, rotate and bend independently of each other allows the base belt 102 to support the weight of the protective vest 106 substantially along the hips of the individual whenever the individual changes body positions.

Figure 7:
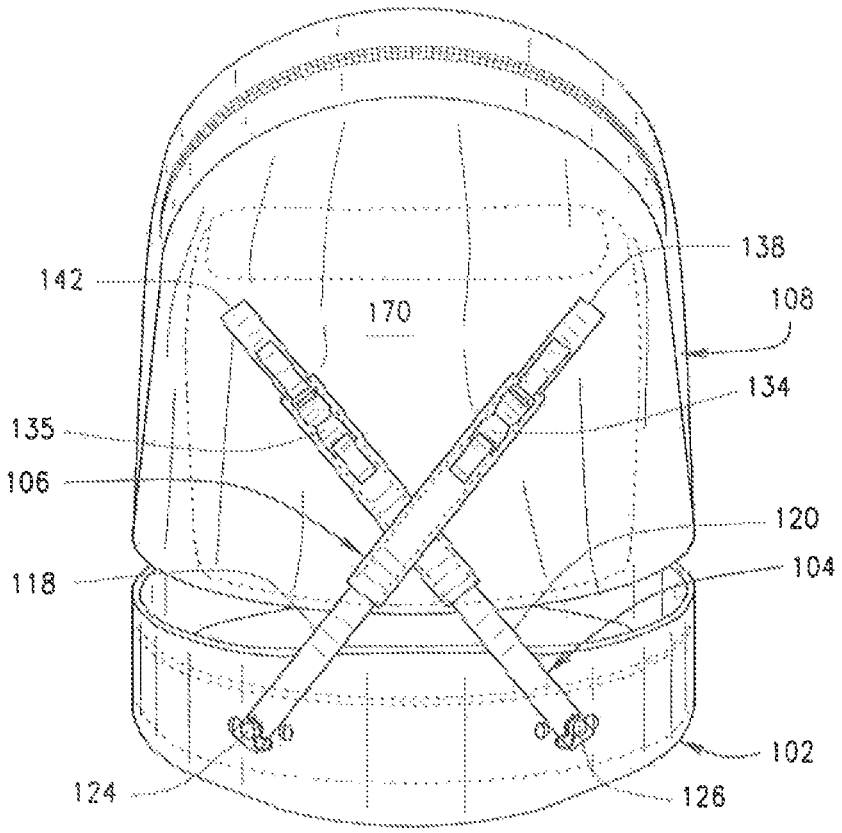
FIG. 7 is a front view of the dynamic load carriage system used with a backpack.

Referring to FIG. 7, in some embodiments the dynamic load carriage system 100 may be engaged to a backpack 108 such as backpacks used for military purposes, camping, school and hiking. In one arrangement, the first and second elongated support members 118 and 120 are secured to the base belt 102 at respective first end portions 136 and 140 using a cotter pin arrangement described above that permits the respective first end portions 136 and 140 to rotate about an axis defined by each respective rod 124 and 126, while the respective second end portions 138 and 140 of the first and second elongated support members 118 and 120 are secured to the cross channel member 109, which is engaged to the rear portion 170 of the backpack 108. Alternatively, the first and second elongated support members 118 and 120 may be engaged to the first and second sleeves 170 and 172 that permit the first and second elongated support members 118 and 120 to slide or otherwise move within the sleeves 170 and 172 when the individual assumes different body positions. In these arrangements, the dynamic load carriage system 100 permits the base belt 102 to support the weight of the backpack 108 substantially along the hips of the individual wearing the backpack 108 whenever the individual assumes different body positions as described herein.

Figure 8:
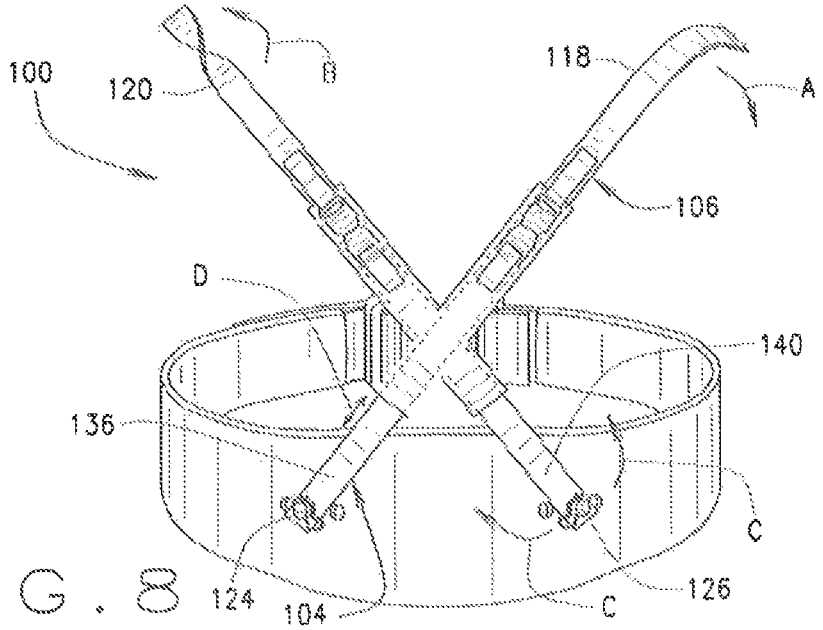
FIG. 8 is a perspective view of the dynamic load carriage system illustrating the various actions of the support cross member in response to a shifting of a load carried by an individual.

Referring to FIG. 8, as described above the first and second elongated support members 118 and 120 are independently capable of a bending action, a twisting action, a rotating action and/or a sliding action whenever the load of the protective vest 109 or backpack 108 shifts due to the individual assuming different body positions. As shown, each of the first and second elongated support members 118 and 120 may exhibit a bending action A wherein the support cross member 104 bends away from the respective longitudinal axis of either of the first and second elongated support members 118 and 120. The first and second elongated support members 118 and 120 may also exhibit a twisting action B wherein the cross support cross member 104 twists substantially along the longitudinal axis of each of the first and second elongated support members 118 and 120 or outside the longitudinal axis thereof when the first and second elongated support members 118 and 120 are simultaneously bent and twisted. In addition, the first and second elongated support members 118 and 120 may exhibit a rotating action C wherein the respective first end portions 136 and 140 rotate about the axis defined by each of the rods 124 and 126 that rotatably engage the first end portions 136 and 140. Finally, the first and second elongated support members 118 and 120 may exhibit a sliding action D relative to the cross channel member 109 wherein one or both of the first and second elongated support members 118 and 120 slides whenever the individual wearing the protective vest 106 or backpack 108 assumes a different body position in order to compensate for a shift in position of the lead carrier relative to the individual.

Referring to FIGS. 9-18, the operation of the dynamic load carriage system 100 is illustrated showing an individual wearing the protective vest 106 in different body positions. In particular, FIGS. 9-18 illustrate the relative lengths of the first and second elongated support members 118 and 120 as each of the first and second elongated support members 118 and 120 changes positions, for example by sliding, relative to the cross channel member 109 as the individual wearing the protective vest 106 assumes different body positions, thereby causing the load carried by the protective vest 106 to shift. The shifting of the load causes the first and second elongated support members 118 and 120, to move relative to each other and the cross channel member 109, which remains stationary and engaged to the protective vest 106, such that the shift in load is supported by the base belt 102 through the compensating movement of the first and second elongated support members 118 and 120 as each elongated support member 118 and/or 120 slides, bends and/or twists in response to the load shift.

Figure 9:
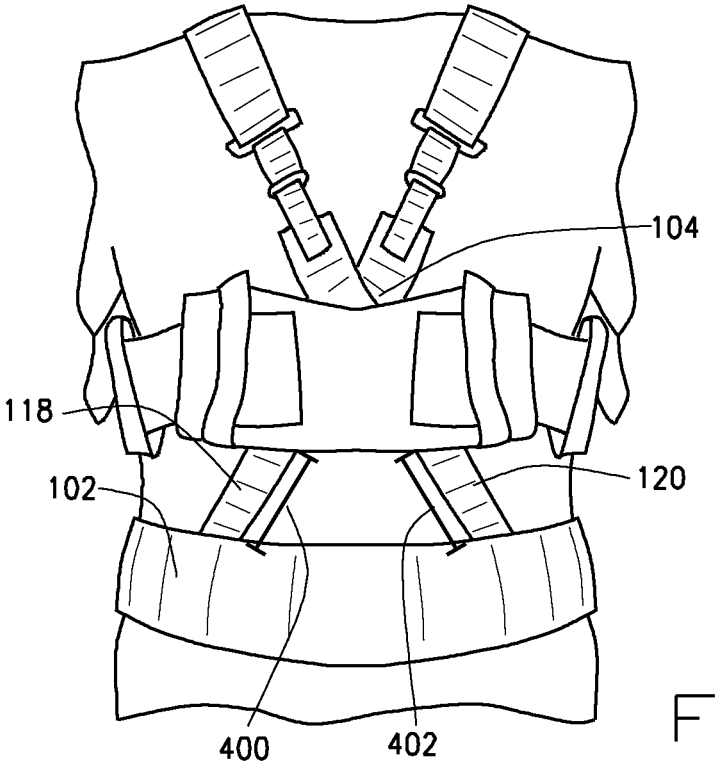
FIG. 9 is a picture showing the position of the dynamic load carriage system when an individual is in an upright standing body position.

As shown in FIG. 9, an individual wearing the protective vest 106 in a standing upright body position allows the first and second elongated support members 118 and 120 to have the substantially the same length as defined between the base belt 102 and the bottom portion of the cross channel member 109, such that in one embodiment the first elongated support member 118 has a length 400 of about 4 inches and the second elongated support member 120 has a length 402 of about 4 inches. In this standing upright body position, the first elongated support member 118 and the second elongated support member 120 remain substantially stationary as the individual walks, or stands, substantially upright while wearing the protective vest 106.

Figure 10:
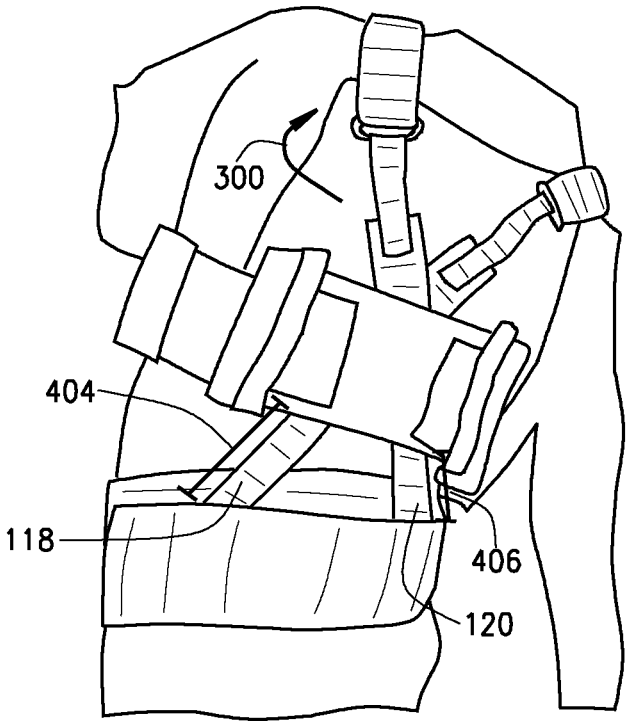
FIG. 10 is a picture showing the position of the dynamic load carriage system when the individual is in a twisting right body position.

Referring to FIG. 10, when the individual wearing the protective vest 106 is in a twisting right side body position 300, the first elongated support member 118 may have a length 404 of about 5 inches and the second elongated support member 120 may have a length 406 of about 4 inches to compensate the shift in load. In this body position 300, the first elongated support member 118 moves relative to the cross-channel member 109 while the second elongated support member 120 remains substantially stationary such that the first elongated support member 118 is more extended than the second elongated support member 120 for accommodating the shift in load.

Figure 11:
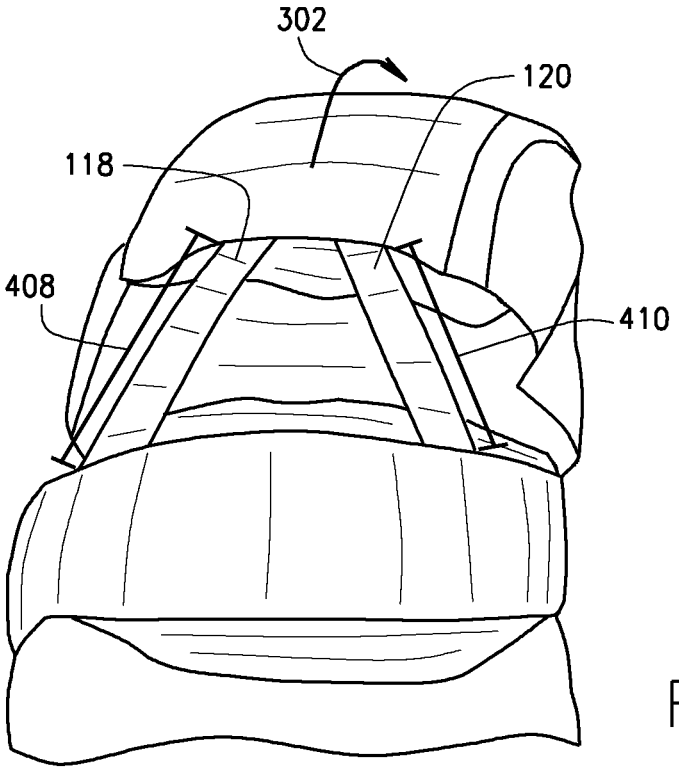
FIG. 11 is a picture showing the position of the dynamic load carriage system when the individual is in a bending straight-over body position with the left hand proximate the right foot.

Referring to FIG. 11, when the individual wearing the protective vest 106 is in a bending straight-over body position 302, the first elongated support member 118 may have a length 408 of about 8 inches and the second elongated support member 120 may have a length 410 of about 7 inches to compensate the shift in load. In this body position 302, both the first and second elongated support members 118 and 120 move relative to the cross channel member 109 such that the first elongated support member 118 is more extended than the first elongated support member 120 for accommodating the shift in load.

Figure 12:
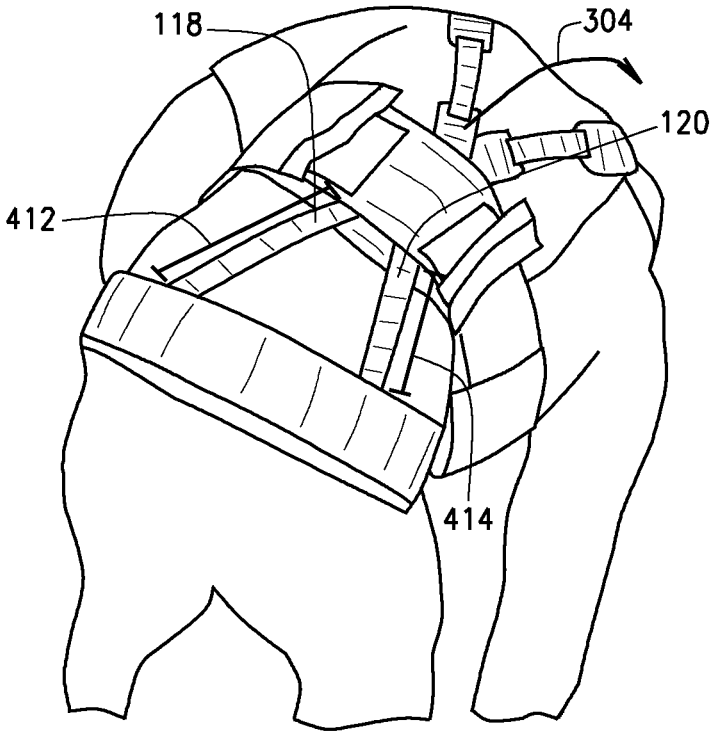
FIG. 12 is a picture showing the position of the dynamic load carriage system when the individual is in a bending over right side body position with the right hand proximate the right knee.

Referring to FIG. 12, when the individual wearing the protective vest 106 is in a bending over right side body position 304 with the right hand proximate the right knee, the first elongated support member 118 may have a length 412 of about 6 inches and a second elongated support member 120 of about 5 inches to compensate the shift in load. In this body position 304, the first elongated support member 118 and the second elongated support member 120 move relative to the cross channel member 106 such that the first elongated support member 118 is slightly more extended than the second elongated support member 120 for accommodating the shift in load.

Figure 13:
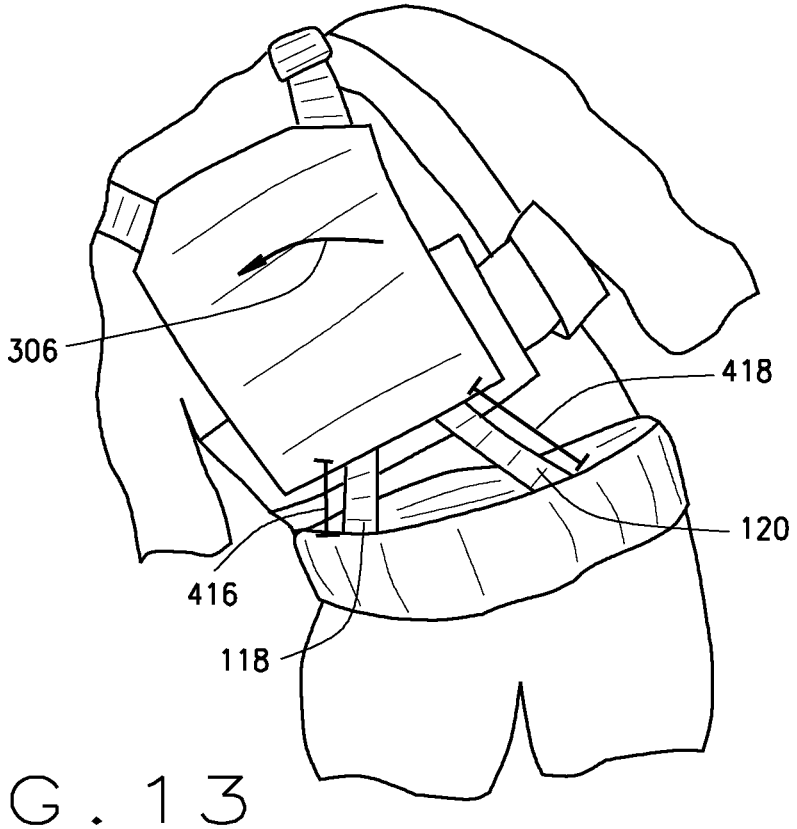
FIG. 13 is a picture showing the position of the dynamic load carriage system when the individual is in a bending left side body position with the left hand proximate the left knee.

Referring to FIG. 13, when the individual wearing the protective vest 106 is in a bending left side body position 306 with the left hand proximate the left knee, the first elongated support member 118 may have a length 416 of about 5 inches and the second elongated support member 120 may have a length 418 of about 6 inches to compensate the shift in load. In this body position 306, the first elongated support member 118 and the second elongated support member 120 move relative to the cross channel member 109 such that the second elongated support member 120 is slightly more extended than the first elongated support member 118 for accommodating the shift in load.

Figure 14:
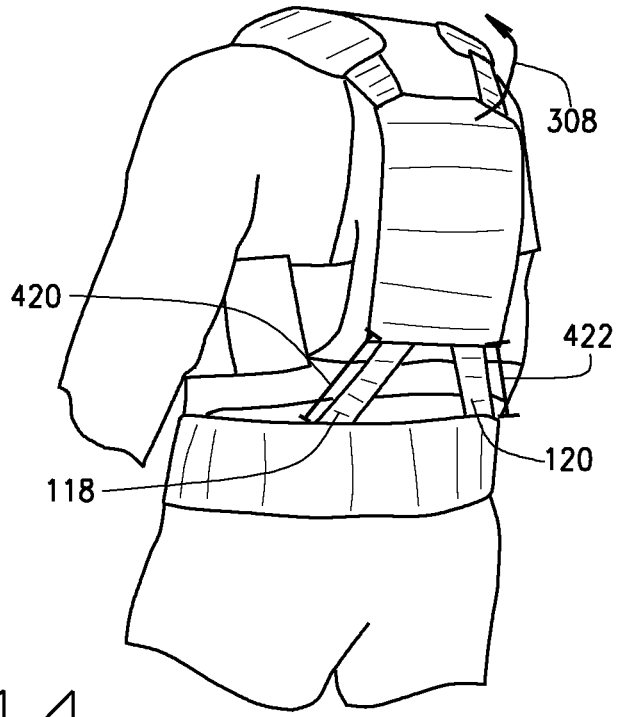
FIG. 14 is a picture showing the position of the dynamic load carriage system when the individual is in an upright twisting left side body position.

Referring to FIG. 14, when the individual wearing the protective vest 106 is in an upright twisting left side body position 308, the first elongated support member may have a length 420 of about 5 inches and the second elongated support member 120 may have a length 422 of about 4 inches to compensate the shift in load. In this body position 308, the first elongated support member 118 moves relative to the cross channel member 109 and the second elongated support member 120 remains substantially stationary such that the first elongated support member 118 is slightly more extended than the second elongated support member 120 for accommodating the shift in load.

Figure 15:
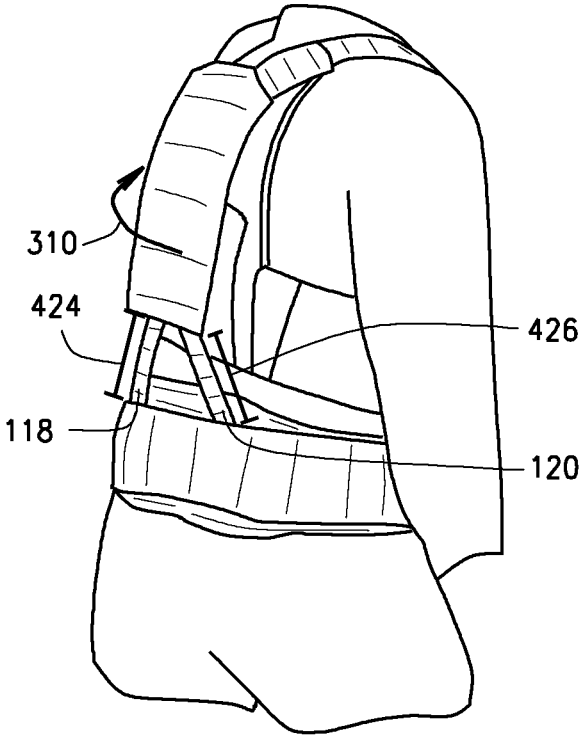
FIG. 15 is a picture showing the position of the dynamic load carriage system when the individual is in an upright twisting right side body position.

Referring to FIG. 15, when the individual wearing the protective vest 106 is in an upright twisting right side body position 310, the first elongated support member 118 may have a length 424 of about 5 inches and the second elongated support member 120 may have a length 426 of about 4 inches to compensate the shift in load. In this body position 310, the first elongated support member 118 moves relative to the cross channel member 109, while the second elongated support member 120 remains substantially stationary such that the first elongated support member 118 is slightly more extended than the second elongated support member 120 for accommodating the shift in load.

Figure 16:
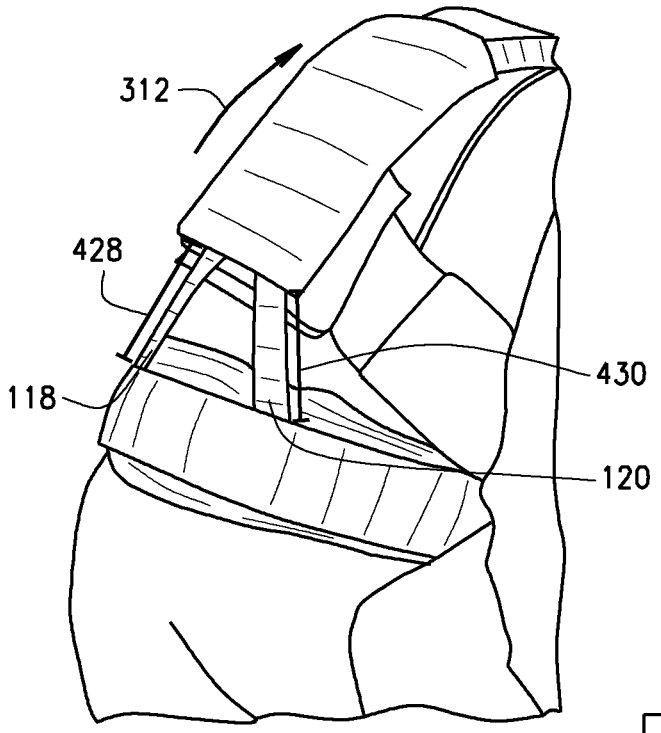
FIG. 16 is a picture showing the position of the dynamic load carriage system when the individual is in a twisting right side body position with the left hand in a downward orientation.

Referring to FIG. 16, when the individual wearing the protective vest 106 is in a twisting right side body position 312 with the left hand in a downward orientation, the first elongated support member 118 may have a length 428 of about 6.5 inches and the second elongated support member 120 may have a length 430 of about 5 inches to compensate the shift in load. In this body position 312, the first elongated support member 118 and the second elongated support member 120 move relative to the cross channel member 109 such that the first elongated support member 118 is more extended than the second elongated support member 120 for accommodating the shift in load.

Figure 17:
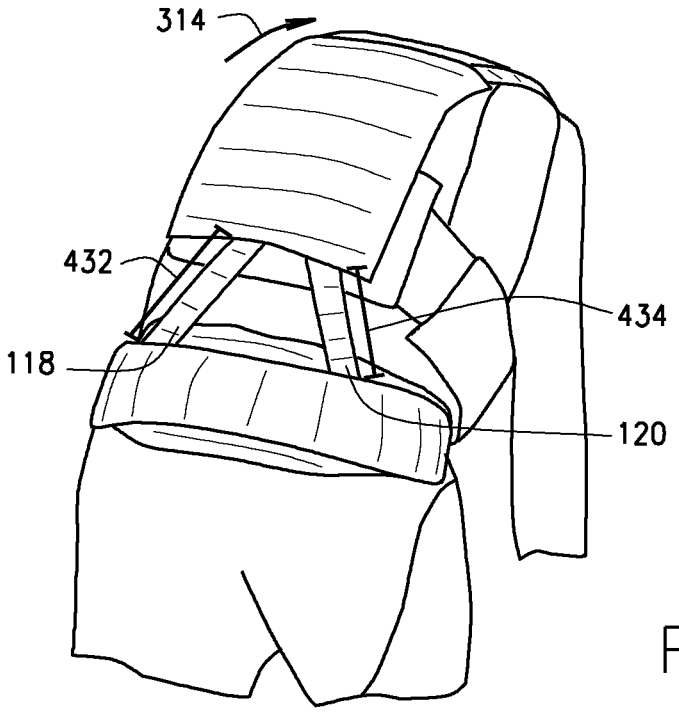
FIG. 17 is a picture showing the position of the dynamic load carriage system when the individual is in a bent over body position with the left hand proximate the right knee.

Referring to FIG. 17, when the individual wearing the protective vest 106 is in bent over body position 314 with the left hand proximate the right knee, the first elongated support member may have a length 432 of about 6 inches and the second elongated support member 120 may have a length 434 of about 5 inches to compensate the shift in load. In this body position 314, first elongated support member 118 and the second elongated support member 120 move relative to the cross channel member 106 such that the first elongated support member 118 is slightly more extended than the second elongated support member 120 for accommodating the shift in load.

Figure 18:
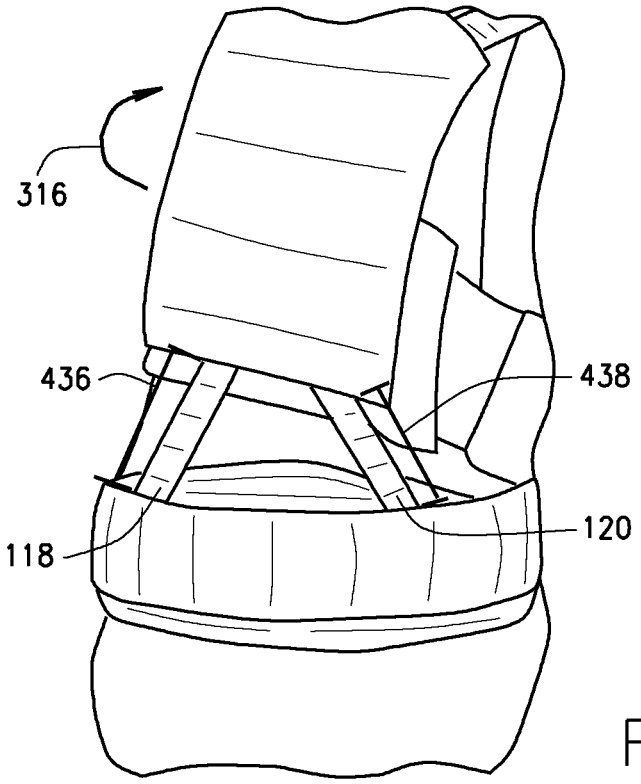
FIG. 18 is a picture showing the position of the dynamic load carriage system when the individual is in a body position with the left hand twisted across the body.

Referring to FIG. 18, when the individual wearing the protective vest 106 is in a twisting right body position 316 with the left hand positioned across the body, the first elongated support member 118 may have a length 436 of about 6 inches and the second elongated support member 120 may have a length 438 of about 5 inches to compensate the shift in load. In this body position 316, the first elongated support member 118 and the second elongated support member 120 move relative to the cross channel member 109 such that the first elongated support member 118 is slightly more extended than the second elongated support member 120 for compensating the shift in load.

Although FIGS. 9-18 illustrate the compensating movements of the first and second elongated support members 118 and 120 of the cross support member 109 when the individual wears the protective vest 106, the same operational principles apply when the individual is wearing a backpack or a load bearing garment (not shown). In addition, when compensating for changes in body position by the individual wearing the dynamic load carrier system 100 the first and second elongated support members 118 and 120 may move in a sliding action, a bending action, a rotating action, a twisting action, or a combination thereof.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A dynamic load carriage system for a wearer comprising:

a base belt comprising a first plurality of holes defined through the base belt at a first location on the base belt and a second plurality of holes defined through the base belt at a second location on the base belt;

a cross channel member having a first body extending from a first proximal end to a first distal end;

a second body of the cross channel member extending from a second proximal end to a second distal end, the second body disposed over the first body;

a first channel defined in and extending through the first body of the cross channel member;

a second channel defined in and extending through the second body of the cross channel member, the first channel disposed in a transverse orientation relative to the second channel;

a first elongated support member formed from a bendable material having a fixed length extending linearly along a first plane between an edge of a first end portion and an edge of a second end portion, the first elongated support member extending from the base belt through the first channel, the first elongated support member defining a first exposed length between the base belt and the first channel, the first exposed length being variable in response to a movement by the wearer;

a first buckle coupled to the first elongated support member;

a first securing strap engageably coupled to the first buckle and configured to attached the dynamic load carriage system to one of a backpack or a protective vest;

a first rod adjustably installed in the base belt via one of the first plurality of holes, the first elongated support member rotatably engaging the first rod;

a second elongated support member formed from the bendable material having a fixed length extending linearly along a second plane between an edge of a first end portion and an edge of a second end portion, the second elongated support member extending from the base belt through the second channel, the second elongated support member defining a second exposed length between the base belt and the second channel, the second exposed length being variable in response to a movement by the wearer; and a second buckle coupled to the second elongated support member;

a second securing strap engageably coupled to the second buckle and configured to attached the dynamic load carriage system to one of the backpack or the protective vest;

a second rod adjustably installed in the base belt via one of the second plurality of holes, the second elongated support member rotatably engaging the second rod, the cross channel member and the first elongated support member and the second elongated support member forming and assembly with a load carriage orientation to allow motion of a user.

2. The dynamic load carriage system of claim 1, wherein the first elongated support member moves within the first channel independently of the second elongated support member moving within the second channel.

3. The dynamic load carriage system of claim 1, wherein the first elongated support member moves within the first channel with at least one action.

4. The dynamic load carriage system of claim 3, wherein the at least one action includes one or more of a sliding action, a rotation action, a twisting action, and a bending action.

5. The dynamic load carriage system of claim 1, wherein the cross channel member is engaged to a load carrier, the first elongated support member and the second elongated support member distributing a weight of a load carried by the load carrier to the base belt.

6. The dynamic load carriage system of claim 5, wherein the movement by the wearer causes a shift in the load, the first elongated support member moving within the first channel and the second elongated support member moving within the second channel in response to the shift in the load.

7. The dynamic load carriage system of claim 1, wherein the first elongated support member is movably coupled to the cross channel member with a strap engaged to a buckle.

8. The dynamic load carriage system of claim 7, wherein the first end portion of the support member includes the strap and the cross channel member includes the buckle.

9. The dynamic load carriage system of claim 8, wherein the second end portion of the first elongated support member opposite the first end portion includes an aperture.

10. The dynamic load carriage system of claim 9, wherein the aperture is disposed relative to at least one securing hole in the base belt, the first elongated support member coupled to the base belt in a rotational engagement with a rod extending through the aperture and the at least one securing hole.

11. The dynamic load carriage system of claim 10, wherein a cotter pin is engaged to the rod in the rotational engagement.

12. The dynamic load carriage system of claim 10, wherein the rotational engagement includes the second end portion of the first elongated support member configured to rotate relative to the base belt in response to the movement by the wearer.

13. A dynamic load carriage system for a wearer comprising:

a load carrier configured to carry a load;

a cross channel member engaged to the load carrier, the cross channel member having a body extending from a proximal end to a distal end;

a first channel defined in and extending through the body of the cross channel member;

a first elongated support member formed from a bendable material and being a stay having a fixed length extending linearly along a plane from an edge of a first end portion to an edge of a second end portion through the first channel, the first elongated support member defining a first exposed length between the base belt and the first channel, the first exposed length being variable in response to a movement by the wearer, the first end portion comprising an aperture;

a base belt comprising a plurality of holes;

a first buckle coupled to the first elongated support member;

a first securing strap engageably coupled to the first buckle and configured to attached the dynamic load carriage system to the load carrier;

a rod adjustably installed in one of the plurality of holes of the base belt, the first end portion installed on the rod through the aperture creating a rotational engagement between the base belt and the first elongated support member, wherein the position of the first end portion of the first elongated support member changes relative to the first channel in response to the movement by the wearer, the first elongated support member distributing a weight of the load carried by the load carrier to the base belt, the cross channel member and the first elongated support member forming and assembly with a load carriage orientation to allow motion of a user.

14. The dynamic load carriage system for a wearer of claim 13, wherein the first end portion is movably coupled to the cross channel member with a strap engaged to a buckle.

15. The dynamic load carriage system of claim 14, wherein a first end portion of the support member includes the strap and the cross channel member includes the buckle.

16. The dynamic load carriage system of claim 13, wherein the second end portion includes an aperture.

17. The dynamic load carriage system of claim 16, wherein the aperture is disposed relative to at least one securing hole in the base belt, the first elongated support member coupled to the base belt in the rotational engagement with a rod and a cotter pin extending through the aperture and the at least one securing hole.

18. The dynamic load carriage system of claim 13, further comprising:

a second elongated support member coupled to the base belt and extending through a second channel defined in the cross channel member.

19. The dynamic load carriage system of claim 18, wherein the first elongated support member is in a transverse orientation relative to the second elongated support member.

20. A dynamic load carriage system for a wearer comprising:

a load carrier configured to carry a load;

a cross channel member engaged to the load carrier, the cross channel member having a first body extending from a first proximal end to a first distal end and a second body extending from a second proximal end to a second distal end, the second body disposed over the first body;

a first channel defined in and extending through the first body of the cross channel member;

a second channel defined in and extending through the second body of the cross channel member;

a first elongated support member formed from a bendable material and having a fixed length extending linearly along a first plane between an edge of a first end portion and an edge of a second end portion, the first elongated support member extending through the first channel, the first elongated support member defining a first exposed length between the base belt and the first channel, the first exposed length being variable in response to a movement by the wearer;

a first buckle coupled to the first elongated support member;

a first securing strap engageably coupled to the first buckle and configured to attached the dynamic load carriage system to the load carrier;

a second elongated support member formed from a bendable material and having a fixed length extending linearly along a second plane between an edge of a first end portion and an edge of a second end portion, the second elongated support member extending through the second channel, the second elongated support member defining a second exposed length between the base belt and the second channel, the second exposed length being variable in response to a movement by the wearer;

a second buckle coupled to the second elongated support member;

a second securing strap engageably coupled to the second buckle and configured to attached the dynamic load carriage system to the load carrier; and a base belt defining a first plurality of holes at a first belt location and a second plurality of holes at a second belt location comprising a first rod and a second rod adjustably installed in the base belt, the first elongated support member coupled to the first rod in a rotational engagement and the second elongated support member coupled to the second rod in a rotational engagement, the first elongated support member and the second elongated support member collectively distributing a weight of the load carried by the load carrier to the base belt, the cross channel member and the first elongated support member and the second elongated support member forming an assembly with a load carriage orientation to allow motion of a user.

* * * * *